US009916802B2

(12) United States Patent
Kuo et al.

(10) Patent No.: US 9,916,802 B2
(45) Date of Patent: Mar. 13, 2018

(54) DISPLAY DEVICE AND OPERATION METHOD THEREOF

(71) Applicant: AU OPTRONICS CORP., Hsin-Chu (TW)

(72) Inventors: Chien-Chih Kuo, Hsin-Chu (TW); Yi-Cheng Lai, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/848,741

(22) Filed: Sep. 9, 2015

(65) Prior Publication Data

US 2016/0358565 A1 Dec. 8, 2016

(30) Foreign Application Priority Data

Jun. 4, 2015 (TW) ..... 104118177 A

(51) Int. Cl.
*G09G 3/36* (2006.01)

(52) U.S. Cl.
CPC ..... *G09G 3/3648* (2013.01); *G09G 3/3655* (2013.01); *G09G 2300/0426* (2013.01)

(58) Field of Classification Search
CPC ..... G09G 3/3648; G09G 2300/0426
See application file for complete search history.

(56) References Cited

U.S. PATENT DOCUMENTS 4,582,395 A * 4/1986 Morozumi ..... G02F 1/136213 257/59
2004/0239667 A1 12/2004 Takahashi
2005/0212735 A1* 9/2005 Lin ..... G09G 3/3611 345/87
2006/0170640 A1* 8/2006 Okuno ..... G09G 3/3655 345/98
2007/0024560 A1 2/2007 Kim et al.
2007/0024565 A1* 2/2007 Choi ..... G09G 3/3655 345/98

(Continued)

FOREIGN PATENT DOCUMENTS

CN 101191925 A 6/2008
JP 2008216834 A 9/2008
TW I352951 11/2011

OTHER PUBLICATIONS

State Intellectual Property Office of the People's Republic of China , "Office Action", dated Jan. 26, 2017.

*Primary Examiner* — Mihir K Rayan
(74) *Attorney, Agent, or Firm* — WPAT, PC

(57) ABSTRACT

A display device includes a data driver, a gate driver, a plurality of first pixel unit and a first low-pass filter. Each first pixel unit includes a first transistor, a first storage capacitor and a first liquid crystal capacitor. The first transistor is electrically coupled to the data driver and the gate driver and from which to receive the first display data and the gate control signal, respectively. The first transistor is configured to output the first display data according to the gate control signal. The first low-pass filter is configured to have its input electrode terminal electrically coupled to the second electrode terminal of one of the plurality of first transistor and its output electrode terminal electrically coupled to the second electrode terminal of the first liquid crystal capacitor of each of the first pixel units. An operation method for the display device is also provided.

8 Claims, 5 Drawing Sheets

(56) References Cited

U.S. PATENT DOCUMENTS

| | | | | |
|---|---|---|---|---|
| 2007/0164963 | A1 | 7/2007 | Kim et al. | |
| 2008/0117148 | A1* | 5/2008 | Tu | G09G 3/3696 345/87 |
| 2008/0278471 | A1 | 11/2008 | Huang | |
| 2008/0303967 | A1* | 12/2008 | Huang | G09G 3/3655 349/39 |
| 2014/0062990 | A1* | 3/2014 | Zhang | G09G 3/3696 345/212 |

* cited by examiner

DISPLAY DEVICE AND OPERATION METHOD THEREOF

TECHNICAL FIELD

The present disclosure relates to a display device and an operation method thereof, and more particularly to a display device and an operation method thereof capable of automatically adjusting common voltage.

BACKGROUND

When a bias voltage applies to liquid crystal cell in a long term, the liquid crystal cell may produce residual charge. The accumulated residual charge increases with time, thus, the rotation of liquid crystal may be affected and eventually image sticking occur. To avoid image sticking, conventionally polarity inversion is adopted for preventing the accumulated residual charge from occurring in the liquid crystal cell. In polarity inversion, the common voltage is used as a reference voltage level. Specifically, the voltage level of display data is referred as having a positive polarity when the voltage level is higher than the voltage level of the common voltage; reversely, the voltage level of display data is referred as having a negative polarity when the voltage level is lower than the voltage level of the common voltage. Ideally, the voltage level of the common voltage is configured at the intermediate value between the positive polarity and the negative polarity. However, because the feed-through effect, the voltage levels of storage capacitor and liquid crystal capacitor may be affected by a change of voltage of gate control signal through a couple of parasitic capacitance. Consequentially, the voltage level of common voltage may not ideally locate at the intermediate value between the positive polarity and the negative polarity, which may result image flicker. In addition, because the different manufacturing plants, different batches or even difference between each two frames, the same design parameters may not apply to all products. In order to solve the problem of common voltage offset, conventionally the offset of common voltage is adjusted manually in the production process. However, because the manual adjustment of common voltage is performed in vision manner, manpower is consuming and image quality may vary with the detectors. Moreover, the offset of common voltage may still occur when the parameters or voltage levels of related component change due to the liquid crystal display device has a long-term usage. Today, the offset of common voltage can be adjusted by specific digital system. However, compared with the conventional liquid crystal display device, the liquid crystal display device adopting digital system for the adjustment of the offset of common voltage may need extra hardware components and cost due to the analog-to-digital conversion of voltage difference and the computation of the adjusted common voltage.

SUMMARY

The present disclosure provides a display device, which includes a data driver, a gate driver, a plurality of first pixel unit and a first low-pass filter. The data driver is configured to output first display data. The gate driver is configured to output a gate control signal. The plurality of first pixel unit is electrically coupled to the data driver and the gate driver. Each one of the plurality of first pixel unit includes a first transistor, a first storage capacitor and a first liquid crystal capacitor. The first transistor has a first electrode terminal, a control electrode terminal and a second electrode terminal. The first transistor is configured to have its first electrode terminal electrically coupled to the data driver and from which to receive the first display data, its control electrode terminal electrically coupled to the gate driver and from which to receive the gate control signal, and its second electrode terminal for outputting the first display data according to the gate control signal. The first storage capacitor has a first electrode terminal and a second electrode terminal. The first storage capacitor is configured to have its first electrode terminal electrically coupled to the second electrode terminal of the first transistor and its second electrode terminal electrically coupled to a low voltage level GND. The first liquid crystal capacitor has a first electrode terminal and a second electrode terminal. The first liquid crystal capacitor is configured to have its first electrode terminal electrically coupled to the second electrode terminal of the first transistor and its second electrode terminal electrically coupled to a first common voltage. The first low-pass filter has an input electrode terminal and an output electrode terminal. The first low-pass filter is configured to have its input electrode terminal electrically coupled to the second electrode terminal of one of the plurality of first transistor and its output electrode terminal electrically coupled to the second electrode terminal of the first liquid crystal capacitor of each of the first pixel units.

The present disclosure further provides an operation method for a display device. The display device includes a data driver, a gate driver, a plurality of pixel unit and a low-pass filter. The data driver is configured to output display data. The gate driver is configured to output a gate control signal. Each one of the plurality of pixel unit includes a transistor, a storage capacitor and a liquid crystal capacitor. The transistor is configured to have its first electrode terminal electrically coupled to the data driver, its control electrode terminal electrically coupled to the gate driver, and its second electrode terminal for outputting the display data according to the gate control signal. The storage capacitor is configured to have its first electrode terminal electrically coupled to the second electrode terminal of the transistor and its second electrode terminal electrically coupled to a low voltage level. The liquid crystal capacitor is configured to have its first electrode terminal electrically coupled to the second electrode terminal of the transistor and its second electrode terminal electrically coupled to a common voltage. The low-pass filter is configured to have its input electrode terminal electrically coupled to the second electrode terminal of one of the plurality of transistor and its output electrode terminal electrically coupled to the second electrode terminal of the liquid crystal capacitor of each of the pixel units. The operation method includes: configuring the plurality of pixel unit to display the display data; and configuring the low-pass filter to filter out an AC part of the display data to obtain a DC level, wherein the DC level is used as a voltage level of the common voltage.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
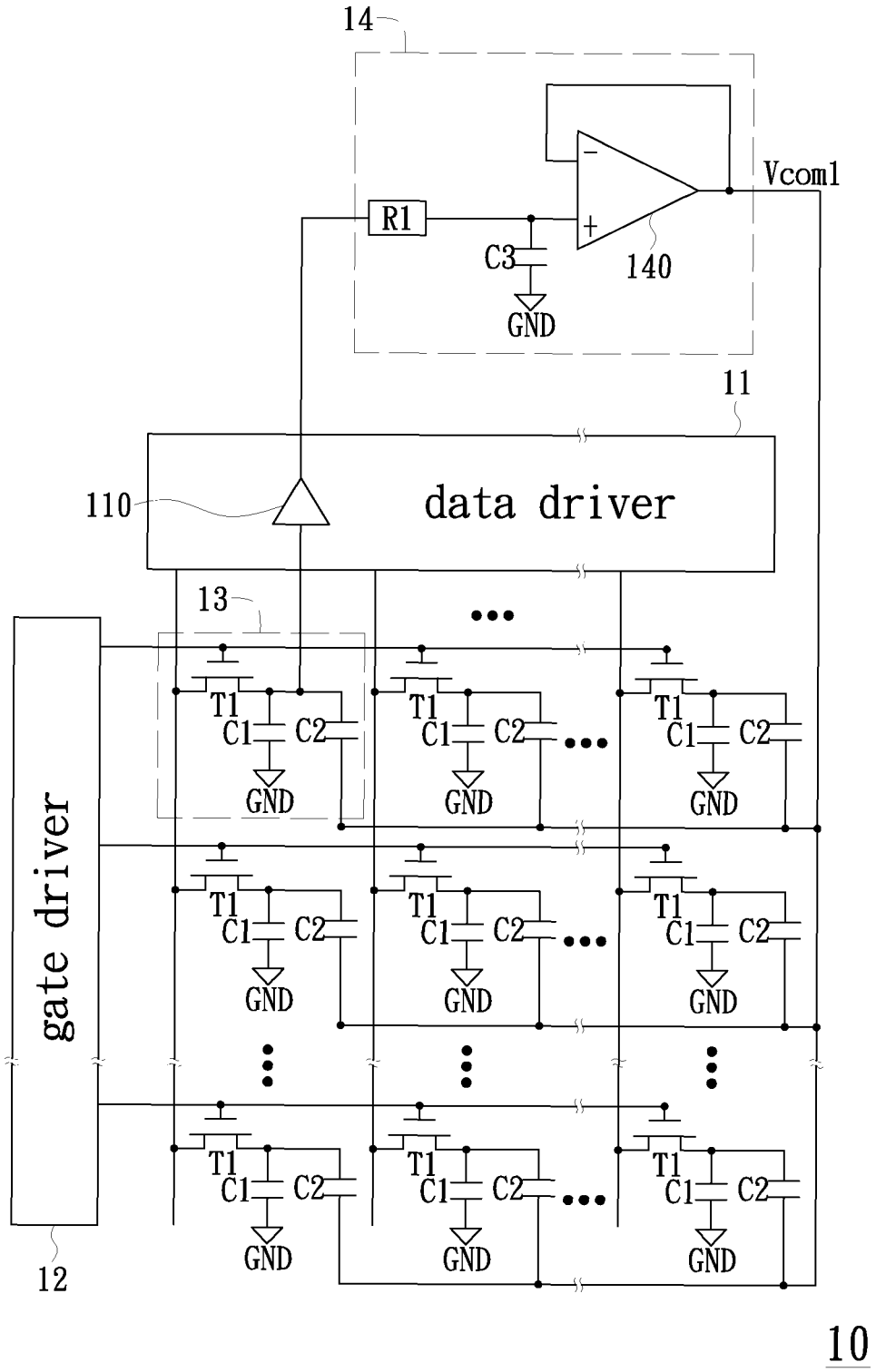
FIG. 1 is a schematic diagram of a display device in accordance with the first embodiment of the present disclosure.

FIG. 1 is a schematic diagram of a display device in accordance with the first embodiment of the present disclosure. As shown in FIG. 1, the display device 10 in the present embodiment includes a data driver 11, a gate driver 12, a plurality of first pixel unit 13 and a first low-pass filter 14. The first pixel units 13 are electrically coupled to the data driver 11 and the gate driver 12. Each of the first pixel units 13 includes a first transistor T1, a first storage capacitor C1 and a first liquid crystal capacitor C2.

The first transistor T1 has a first electrode terminal, a control electrode terminal and a second electrode terminal. The first transistor T1 is configured to have its first electrode terminal electrically coupled to the data driver 11 and from which to receive first display data, its control electrode terminal electrically coupled to the gate driver 12 and from which to receive a gate control signal, and its second electrode terminal for outputting the first display data according to the gate control signal. The first storage capacitor C1 has a first electrode terminal and a second electrode terminal. The first storage capacitor C1 is configured to have its first electrode terminal electrically coupled to the second electrode terminal of the first transistor T1 and from which to receive the first display data and its second electrode terminal electrically coupled to a low voltage level GND. The first liquid crystal capacitor C2 has a first electrode terminal and a second electrode terminal. The first liquid crystal capacitor C2 is configured to have its first electrode terminal electrically coupled to the second electrode terminal of the first transistor T1 and its second electrode terminal electrically coupled to the first low-pass filter 14 and from which to receive a first common voltage Vcom1 outputted from an output electrode terminal of the first low-pass filter 14.

The first low-pass filter 14 has an input electrode terminal and an output electrode terminal. The first low-pass filter 14 includes a resistor R1, a capacitor C3 and an operational amplifier 140, but the present disclosure is not limited thereto. The resistor R1 has a first electrode terminal and a second electrode terminal. The resistor R1 is configured to have its first electrode terminal referred as the input electrode terminal of the first low-pass filter 14 and electrically coupled to the second electrode terminal of one of the plurality of first transistor T1. The capacitor C3 has a first electrode terminal and a second electrode terminal. The capacitor C3 is configured to have its first electrode terminal electrically coupled to the second electrode terminal of the resistor R1 and its second electrode terminal electrically coupled to the low voltage level GND. The operational amplifier 140 has a positive input electrode terminal, a negative input electrode terminal and an output electrode terminal. The operational amplifier 140 is configured to have its positive input electrode terminal electrically coupled to the second electrode terminal of the resistor R1 and the first electrode terminal of the capacitor C3, its negative input electrode terminal electrically coupled to its output electrode terminal, and its output electrode terminal referred as the output electrode terminal of the first low-pass filter 14. The first low-pass filter 14 is configured to have its output electrode terminal electrically coupled to the second electrode terminal of the first liquid crystal capacitor C2 of each of the first pixel units 13 and for outputting the updated first common voltage Vcom1 to the first pixel units 13.

Figure 2:
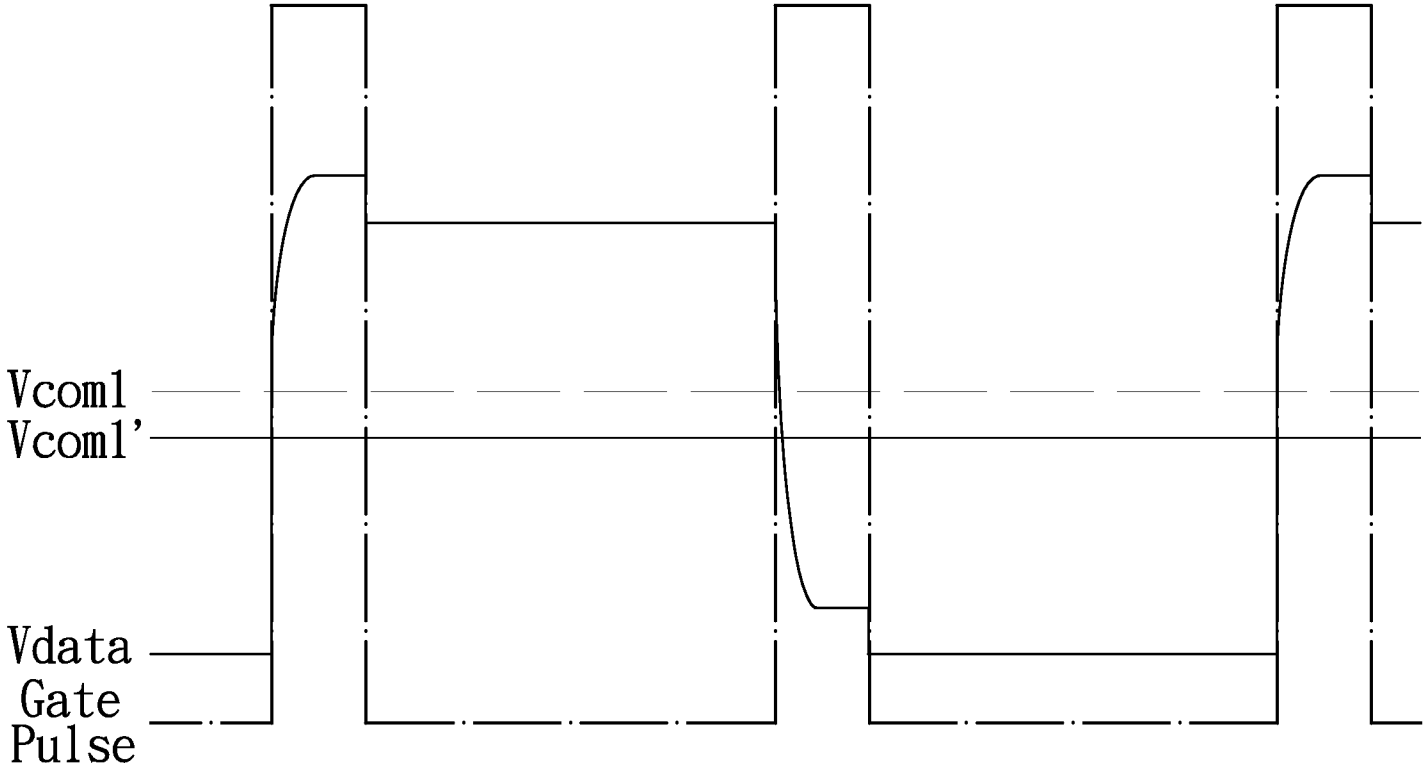
FIG. 2 is a timing chart of related signals used in the display device of FIG. 1 in accordance with an embodiment of the present disclosure.

Because polarity inversion is for alternatively displaying display data with positive polarity and display data with negative polarity, polarity inversion can be regarded as a part of alternating current (AC). Thus, when the first transistor T1, electrically coupled to the input electrode terminal of the first low-pass filter 14, transmits the first display data to the second electrode terminal thereof according to the gate control signal, the first low-pass filter 14 can filter out the AC part of the first display data to obtain a DC level; wherein the DC level is referred as the updated first common voltage Vcom1. In addition, because the duty cycles of the first display data with positive polarity and with negative polarity each are 50%, the first low-pass filter 14 can output a first common voltage Vcom1' which has a voltage level equal to the intermediate value of the first display data Vdata and transmit the first common voltage Vcom1' to the plurality of electrically-coupled first pixel units 13 immediately, thereby adjusting and maintaining the first common voltage Vcom1 at the intermediate value of the first display data so as to avoid the image flicker. In FIG. 2, Vdata denotes the first display data at the second electrode terminal of the first transistor T1 electrically coupled to the input electrode terminal of the first low-pass filter 14, Gate Pulse denotes the gate control signal, and Vcom denotes the first common voltage. As shown in FIG. 2, when the gate control signal ends the working voltage level, the voltage level of the first display data drops due to the feed-through effect and accordingly the voltage level of the first common voltage Vcom1 has offset and may not be actually equal to the intermediate value of the first display data. In the present embodiment, because the first low-pass filter 14 is configured to receive the first display data, filter out the AC part of the received first display data, output a DC level equal to the intermediate value of the first display data (that is, Vcom1' in FIG. 2) and transmit the DC level to the second electrode terminal of the first liquid crystal capacitors C2. As a result, the first common voltage Vcom1 is adjusted to the first common voltage Vcom1' having a DC level equal to the intermediate value of the first display data.

In the present embodiment, the first low-pass filter 14 and the first pixel unit 13 may be electrically coupled to each other through a buffer 110 disposed in the data driver 11. Specifically, the buffer 110 is electrically coupled between the second electrode terminal of one of the plurality of first transistor T1 and the input electrode terminal of the first low-pass filter 14. The buffer 110 has an input electrode terminal and an output electrode terminal. The buffer 110 is configured to have its input electrode terminal electrically coupled to the second electrode terminal of one first transistor T1 and its output electrode terminal electrically coupled to the input electrode terminal of the first low-pass filter 14. As the data driver 11 is equipped with the buffer 110, no any additional wiring layout for the electrical connection between the first low-pass filter 14 and the first pixel units 13 of the present disclosure is needed. Thus, not only the cost is reduced but also the attenuation and interference caused by the additional wiring layout are avoided.

Figure 3:
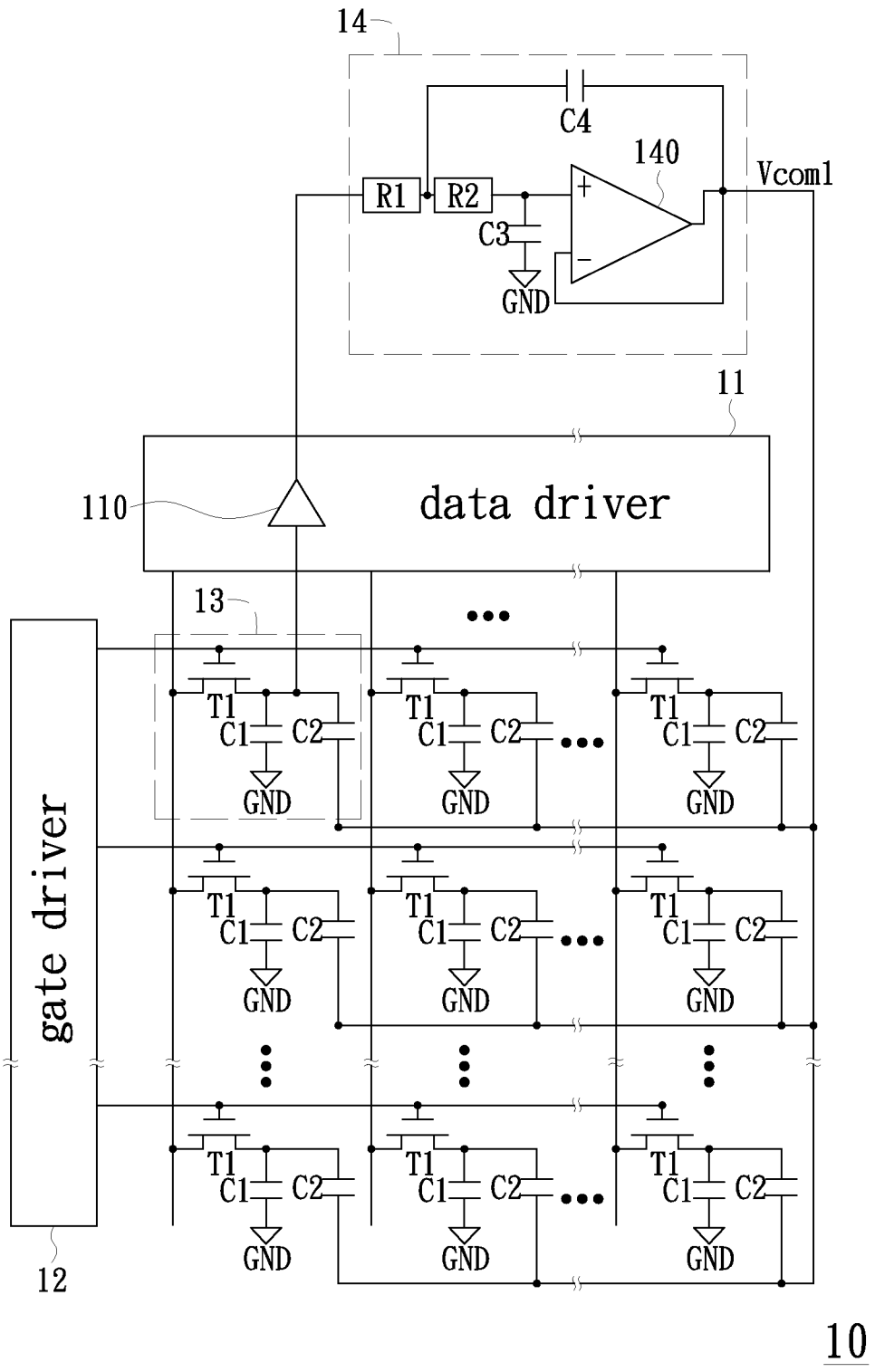
FIG. 3 is a schematic diagram of a display device in accordance with the second embodiment of the present disclosure.

Refer to FIG. 3, which is a schematic diagram of a display device in accordance with the second embodiment of the present disclosure. As shown in FIG. 3, the main difference between the display device 10 in the second embodiment of FIG. 3 and the display device 10 in the first embodiment of FIG. 1 is that the first low-pass filter 14 in the present embodiment may be a second-order low-pass filter, but the present disclosure is not limited thereto. Specifically, the first low-pass filter 14 in the present embodiment further includes a resistor R2 and a capacitor C4. The resistor R1 has a first electrode terminal and a second electrode terminal. The resistor R1 is configured to have its first electrode terminal referred as the input electrode terminal of the first low-pass filter 14 and electrically coupled to the second electrode terminal of one of the plurality of first transistor T1. The resistor R2 has a first electrode terminal and a second electrode terminal. The resistor R2 is configured to have its first electrode terminal electrically coupled to the second electrode terminal of the resistor R1. The capacitor C3 has a first electrode terminal and a second electrode terminal. The capacitor C3 is configured to have its first electrode terminal electrically coupled to the second electrode terminal of the resistor R2 and its second electrode terminal electrically coupled to the low voltage level GND. The operational amplifier 140 has a positive input electrode terminal, a negative input electrode terminal and an output electrode terminal. The operational amplifier 140 is configured to have its positive input electrode terminal electrically coupled to the second electrode terminal of the resistor R2 and the first electrode terminal of the capacitor C3 and its negative input electrode terminal electrically coupled to its output electrode terminal. The capacitor C4 has a first electrode terminal and a second electrode terminal. The capacitor C4 is configured to have its first electrode terminal electrically coupled to the second electrode terminal of the resistor R1 and its second electrode terminal electrically coupled to the output electrode terminal of the operational amplifier 140. The output electrode terminal of the operational amplifier 140 is referred as the output electrode terminal of the first low-pass filter 14. The first low-pass filter 14 is further configured to have its output electrode terminal electrically coupled to the second electrode terminal of the first liquid crystal capacitor C2 of each of the first pixel units 13.

Same as in the first embodiment, in the second embodiment, when the first transistor T1, electrically coupled to the input electrode terminal of the first low-pass filter 14, transmits the first display data to the second electrode terminal thereof according to the gate control signal, the first low-pass filter 14 can filter out the AC part of the first display data to obtain a DC level; wherein the DC level is referred as the updated first common voltage Vcom1. As a result, the first common voltage Vcom1 is adjusted to the first common voltage Vcom1' having a DC level equal to the intermediate value of the first display data.

Figure 4:
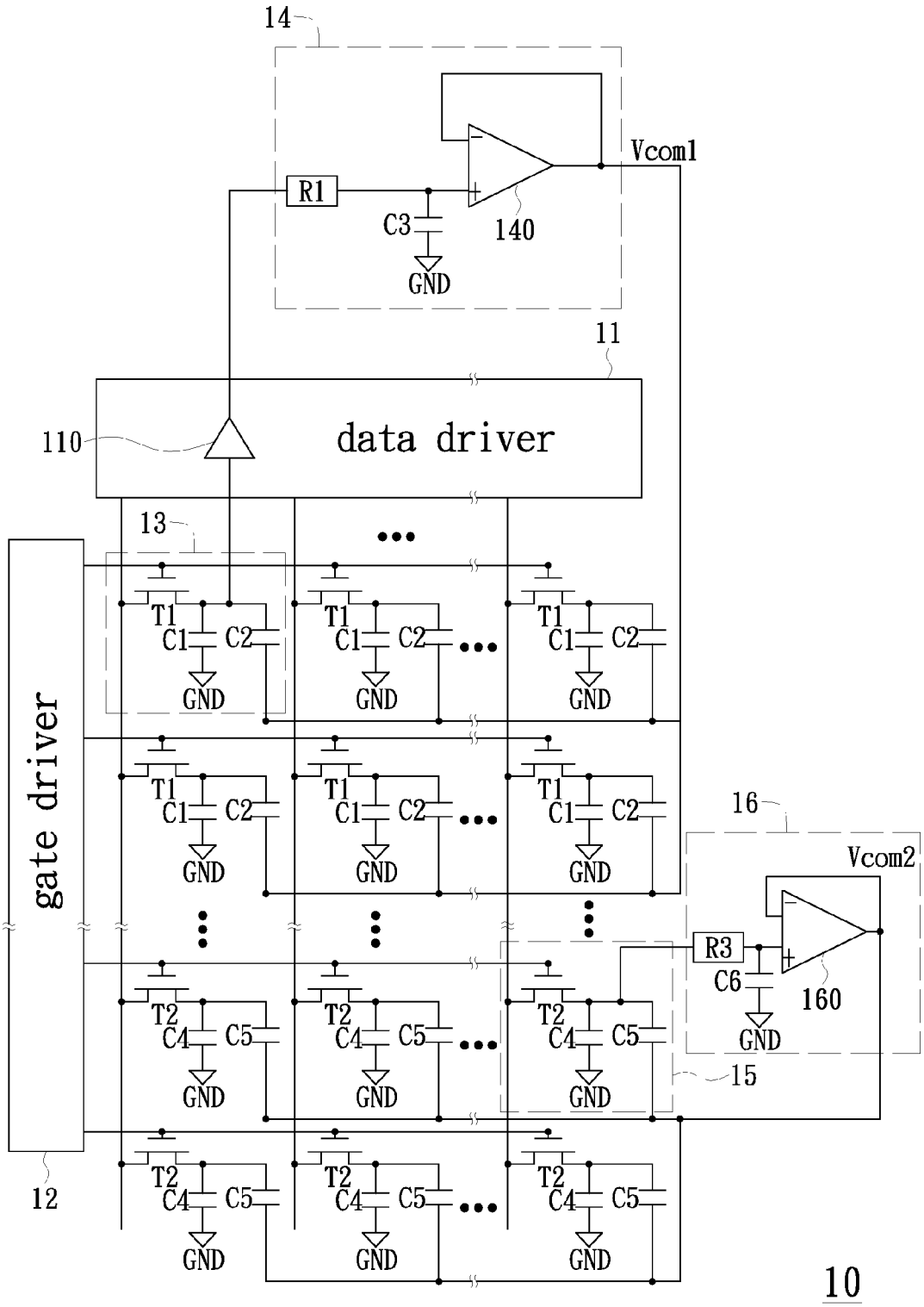
FIG. 4 is a schematic diagram of a display device in accordance with the third embodiment of the present disclosure.

Please refer to FIG. 4, which is a schematic diagram of a display device in accordance with the third embodiment of the present disclosure. As shown in FIG. 4, the main difference between the display device 10 in the third embodiment of FIG. 4 and the display device 10 in the first embodiment of FIG. 1 is that the display device 10 in the third embodiment further includes a plurality of second pixel unit 15 and a second low-pass filter 16 electrically coupled to the second pixel units 15. The second low-pass filter 16 in the present embodiment may be a low-pass filter having at least one order such as a first-order low-pass filter or a second-order low-pass filter. Herein a first-order low-pass filter is taken as an example for the following description. Each one of the second pixel units 15 is electrically coupled to the data driver 11 and the gate driver 12. Each one of the second pixel units 15 includes a second transistor T2, a second storage capacitor C4 and a second liquid crystal capacitor C5. The second transistor T2 has a first electrode terminal, a control electrode terminal and a second electrode terminal. The second transistor T2 is configured to have its first electrode terminal electrically coupled to the data driver 11 and from which to receive second display data, its control electrode terminal electrically coupled to the gate driver 12 and from which to receive a gate control signal, and its second electrode terminal for outputting the second display data according to the gate control signal. The second storage capacitor C4 has a first electrode terminal and a second electrode terminal. The second storage capacitor C4 is configured to have its first electrode terminal electrically coupled to the second electrode terminal of the second transistor T2 and its second electrode terminal electrically coupled to the low voltage level GND. The second liquid crystal capacitor C5 has a first electrode terminal and a second electrode terminal. The second liquid crystal capacitor C5 is configured to have its first electrode terminal electrically coupled to the second electrode terminal of the second transistor T2 and its second electrode terminal electrically coupled to the second low-pass filter 16 and from which to receive a second common voltage Vcom2. The second low-pass filter 16 has an input electrode terminal and an output electrode terminal. The second low-pass filter 16 is configured to have its input electrode terminal electrically coupled to the second electrode terminal of one of the plurality of second transistor 15 and its output electrode terminal electrically coupled to the second electrode terminal of the second liquid crystal capacitor C5 of each of the second pixel units 15. The second low-pass filter 16 includes a resistor R3, a capacitor C6 and an operational amplifier 160. The resistor R3 has a first electrode terminal and a second electrode terminal. The resistor R3 is configured to have its first electrode terminal referred as the input electrode terminal of the second low-pass filter 16. The capacitor C6 has a first electrode terminal and a second electrode terminal. The capacitor C6 is configured to have its first electrode terminal electrically coupled to the second electrode terminal of the resistor R3 and its second electrode terminal electrically coupled to the low voltage level GND. The operational amplifier 160 has a positive input electrode terminal, a negative input electrode terminal and an output electrode terminal. The operational amplifier 160 is configured to have its positive input electrode terminal electrically coupled to the second electrode terminal of the resistor R3 and the first electrode terminal of the capacitor C6, its negative input electrode terminal electrically coupled to its output electrode terminal, and its output electrode terminal referred as the output electrode terminal of the second low-pass filter 16.

Thus, when the second transistor T2, electrically coupled to the input electrode terminal of the second low-pass filter 16, transmits the second display data to the second electrode terminal thereof according to the gate control signal, the second low-pass filter 16 can filter out the AC part of the second display data to obtain a DC level; wherein the DC level is referred as the updated second common voltage Vcom2. In addition, because the duty cycles of the second display data with positive polarity and with negative polarity each are 50%, the second low-pass filter 16 can output the common voltage Vcom2 which has a voltage level equal to the intermediate value of the second display data and transmit the common voltage Vcom2 to the plurality of electrically-coupled second pixel units 15 immediately, thereby adjusting and maintaining the common voltage Vcom2 at the intermediate value of the second display data so as to avoid the image flicker.

Figure 5:
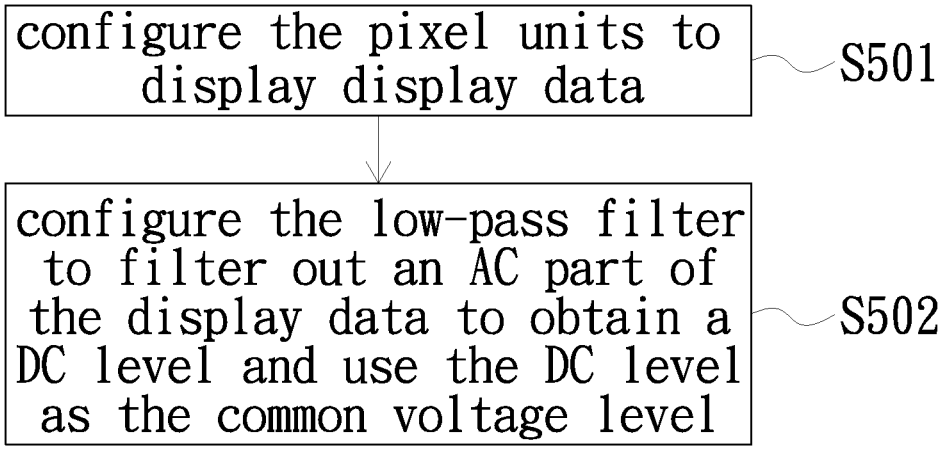
FIG. 5 is flow chart of an operation method for a display device in accordance with an embodiment of the present disclosure.

According to the above description, an operation method for a display device is obtained in the present disclosure. Please refer to FIG. 5, which is flow chart of an operation method for a display device in accordance with an embodiment of the present disclosure. As shown in FIG. 5, the operation method in the present embodiment includes steps of: configuring the pixel units to display the received display data (step S501); and configuring the low-pass filter to receive the display data of the pixel units, filter out an AC part of the display data to obtain a DC level, wherein the DC level is equal to the intermediate value of the display data and used as the voltage level of the common voltage (step S502).

In summary, the display device of the present disclosure is equipped with a low-pass filter configured to automatically output, according to the received display data, a DC level equal to the intermediate value of the display data to the pixel units. Thus, the image flicker resulted by the voltage level of the common voltage being not equal to the intermediate value of the display data is avoided. In addition, because the low-pass filter can be implemented by the original common-voltage adjusting circuit in the display device, the common voltage can be automatically adjusted by the low-pass filter in the present disclosure without any extra component and cost.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display device, comprising:

a data driver, configured to output a first display data;

a gate driver, configured to output a gate control signal;

a plurality of first pixel unit, electrically coupled to the data driver and the gate driver, each one of the plurality of first pixel unit comprising:

a first transistor, having a first electrode terminal, a control electrode terminal and a second electrode terminal, the first transistor being configured to have its first electrode terminal electrically coupled to the data driver and from which to receive the first display data, its control electrode terminal electrically coupled to the gate driver and from which to receive the gate control signal, and its second electrode terminal for outputting the first display data according to the gate control signal;

a first storage capacitor, having a first electrode terminal and a second electrode terminal, the first storage capacitor being configured to have its first electrode terminal electrically coupled to the second electrode terminal of the first transistor and its second electrode terminal electrically coupled to a low voltage level GND; and a first liquid crystal capacitor, having a first electrode terminal and a second electrode terminal, the first liquid crystal capacitor being configured to have its first electrode terminal electrically coupled to the second electrode terminal of the first transistor and its second electrode terminal electrically coupled to a first common voltage; and a first low-pass filter, having an input electrode terminal and an output electrode terminal, the first low-pass filter being configured to have its input electrode terminal electrically coupled to the second electrode terminal of one of the plurality of first transistor and its output electrode terminal electrically coupled to the second electrode terminal of the first liquid crystal capacitor of each of the first pixel units for outputting a intermediate value of the first display data in one frame.

2. The display device according to claim 1, wherein the data driver comprises a buffer electrically coupled between the second electrode terminal of one of the plurality of first transistor and the input electrode terminal of the first low-pass filter, the buffer has an input electrode terminal and an output electrode terminal, the buffer is configured to have its input electrode terminal electrically coupled to the second electrode terminal of the first transistor and its output electrode terminal electrically coupled to the input electrode terminal of the first low-pass filter.

3. The display device according to claim 1, further comprising:

a plurality of second pixel unit, electrically coupled to the data driver and the gate driver, the plurality of second pixel unit being configured to receive a second display data from the data driver, each one of the plurality of second pixel unit comprising:

a second transistor, having a first electrode terminal, a control electrode terminal and a second electrode terminal, the second transistor being configured to have its first electrode terminal electrically coupled to the data driver and from which to receive the second display data, its control electrode terminal electrically coupled to the gate driver and from which to receive the gate control signal, and its second electrode terminal for outputting the second display data according to the gate control signal;

a second storage capacitor, having a first electrode terminal and a second electrode terminal, the second storage capacitor being configured to have its first electrode terminal electrically coupled to the second electrode terminal of the second transistor and its second electrode terminal electrically coupled to the low voltage level GND; and a second liquid crystal capacitor, having a first electrode terminal and a second electrode terminal, the second liquid crystal capacitor being configured to have its first electrode terminal electrically coupled to the second electrode terminal of the second transistor and its second electrode terminal electrically coupled to a second common voltage; and a second low-pass filter, having an input electrode terminal and an output electrode terminal, the second low-pass filter being configured to have its input electrode terminal electrically coupled to the second electrode terminal of one of the plurality of second transistor and its output electrode terminal electrically coupled to the second electrode terminal of the second liquid crystal capacitor of each of the second pixel units.

4. The display device according to claim 3, wherein the second low-pass filter is a low-pass filter having at least one order such as a first-order low-pass filter or a second-order low-pass filter.

5. The display device according to claim 1, wherein the first low-pass filter is a low-pass filter having at least one order such as a first-order low-pass filter or a second-order low-pass filter.

6. An operation method for a display device, the display device comprising a data driver, a gate driver, a plurality of pixel unit and a low-pass filter, the data driver being configured to output a display data, the gate driver being configured to output a gate control signal, each one of the plurality of pixel unit comprising a transistor, a storage capacitor and a liquid crystal capacitor, the transistor being configured to have its first electrode terminal electrically coupled to the data driver, its control electrode terminal electrically coupled to the gate driver, and its second electrode terminal for outputting the display data according to the gate control signal, the storage capacitor being configured to have its first electrode terminal electrically coupled to the second electrode terminal of the transistor and its second electrode terminal electrically coupled to a low voltage level GND, the liquid crystal capacitor being configured to have its first electrode terminal electrically coupled to the second electrode terminal of the transistor and its second electrode terminal electrically coupled to a common voltage, the low-pass filter being configured to have its input electrode terminal electrically coupled to the second electrode terminal of one of the plurality of transistor and its output electrode terminal electrically coupled to the second electrode terminal of the liquid crystal capacitor of each of the pixel units, the operation method comprising:

configuring the plurality of pixel unit to display the display data; and configuring the low-pass filter to filter out an AC part of the display data to obtain a DC level in one frame, wherein the DC level is an intermediate value of the first display data and is used as a voltage level of the common voltage.

7. The operation method according to claim 6, wherein the low-pass filter is a low-pass filter having at least one order such as a first-order low-pass filter or a second-order low-pass filter.

8. The operation method according to claim 6, wherein the data driver comprises a buffer electrically coupled between the second electrode terminal of one of the plurality of transistor and the input electrode terminal of the low-pass filter, the buffer has an input electrode terminal and an output electrode terminal, the buffer is configured to have its input electrode terminal electrically coupled to the second electrode terminal of the transistor and its output electrode terminal electrically coupled to the input electrode terminal of the low-pass filter.

* * * * *